US005468584A

United States Patent [19]

Go et al.

[11] Patent Number: 5,468,584

[45] Date of Patent: Nov. 21, 1995

[54] ELECTROPHOTOGRAPHIC PHOTOSENSITIVE MEMBER HAVING INTERMEDIATE LAYER CONTAINING FINE POWDER PARTICLES OF TIN OXIDE CONTAINING PHOSPHOROUS AND APPARATUS EMPLOYING SAME

[75] Inventors: Shintetsu Go; Yoshio Kashizaki, both of Yokohama; Koichi Suzuki, Kawasaki; Kazuma Sato, Yokohama; Akira Shimada, Tokyo, all of Japan

[73] Assignee: Canon Kabushiki Kaisha, Tokyo, Japan

[21] Appl. No.: 410,395

[22] Filed: Mar. 27, 1995

Related U.S. Application Data

[63] Continuation of Ser. No. 159,563, Dec. 1, 1993, abandoned.

[30] Foreign Application Priority Data

Dec. 1, 1992 [JP] Japan ..... 4-343598

[51] Int. Cl.$^6$ ..... G03G 5/14

[52] U.S. Cl. ..... 430/65; 430/63; 355/211

[58] Field of Search ..... 430/60, 62, 63, 430/65; 355/211

[56] References Cited

U.S. PATENT DOCUMENTS

| | | | |
|---|---|---|---|
| 3,393,070 | 7/1968 | Snelling | 430/63 |
| 5,128,226 | 7/1992 | Hung | 430/58 |
| 5,278,013 | 1/1994 | Kashizaki et al. | 430/58 |
| 5,320,922 | 6/1994 | Mayama et al. | 430/63 |

FOREIGN PATENT DOCUMENTS

| | | | |
|---|---|---|---|
| 454233 | 10/1991 | European Pat. Off. . | |
| 54-151843 | 11/1979 | Japan | G03G 5/14 |
| 58-181054 | 10/1983 | Japan | G03G 5/14 |
| 1-118848 | 5/1989 | Japan | G03G 5/14 |
| 2075365 | 11/1981 | United Kingdom . | |

OTHER PUBLICATIONS

Patent Abstracts of Japan, vol. 13, No. 593 (M–914) Dec. 1989 of JPA 01–249436.

Database WPI, Section Ch, Week 8537, Derwent Publications Class S06, AN 85–225654 of JPA 60–144755.

*Primary Examiner*—John Goodrow
*Attorney, Agent, or Firm*—Fitzpatrick, Cella, Harper & Scinto

[57] ABSTRACT

An electrophotographic photosensitive member includes, in orders, a supporting member, and an intermediate layer and a photoconductive layer. The intermediate layer contains a powder of fine particles of tin oxide containing phosphorus.

10 Claims, 1 Drawing Sheet

ELECTROPHOTOGRAPHIC PHOTOSENSITIVE MEMBER HAVING INTERMEDIATE LAYER CONTAINING FINE POWDER PARTICLES OF TIN OXIDE CONTAINING PHOSPHOROUS AND APPARATUS EMPLOYING SAME

This application is a continuation of application Ser. No. 08/159,563 filed Dec. 1, 1993, now abandoned.

BACKGROUND OF THE INVENTION

The present invention relates to an electrophotographic photosensitive member and an electrophotographic apparatus which employs the same.

An electrophotographic photosensitive member is basically formed from a supporting member and a photoconductive layer formed on the supporting member. However, an intermediate layer provided between the photoconductive layer and the supporting member is effective for covering the defects of the supporting member, improving the coating of the photoconductive layer, improving adhesion between the photoconductive layer and the supporting member, protecting the photoconductive layer from being electrically isolated, improving the charging of the photoconductive layer and improving charge injection from the supporting layer to the photoconductive layer. Hence, it is required that the intermediate layer of the electrophotographic photosensitive member is coated and adhered well, exhibits a high mechanical strength, is appropriately conductive and offers an electrical barrier.

The types of intermediate layers which have been proposed are as follows:

(i) A thin resin film containing no conductive filler, (ii) A thin resin film containing a conductive filler, and (iii) A laminated layer in which the thin film of (i) is laid on top of the thin film of (ii).

Since the thin film of (i) contains no conductive filler, it has a high electric resistance. Further, in order to cover the defects of the supporting member, the film must be made thick. The thin film of (i), then, has a disadvantage in that the residual potential at the initial stage of use thereof or when the thin film is used repeatedly, is high. To make the thin film of (i) practical, the defects of the supporting member must be reduced and the thickness of the intermediate layer must be reduced greatly.

The thin film of (ii) or (iii) can be made appropriately conductive because of the dispersed conductive filler. However, if the dispersion of the conductive filler is degraded, then the electrical characteristics of the intermediate layer, such as an electric resistance or a dielectric constant thereof, changes. Such variations adversely affect the potential characteristics or image formation. A degraded dispersion also degrades the uniform flatness of the film surface, causing coating defects to occur. Further, the degraded dispersion of the filler reduces the adhesion of the intermediate layer to the supporting member and the mechanical strength of the intermediate layer.

Examples of the conventional conductive fillers of the intermediate layer include a conductive metal filler (disclosed in Japanese Patent Laid-Open No. sho 58-181054), a conductive metal oxide filler (disclosed in Japanese Patent Laid-Open No. sho 54-151843), and a conductive metal nitride filler (Japanese Patent Laid-Open No. hei 1-118848).

However, an electrophotographic photosensitive member which employs, as the filler of the intermediate layer, any of the conventional conductive fillers is highly dependent on changes in the ambient environment, such as temperature or humidity. Accordingly, employing conventional conductive fillers makes it difficult to manufacture a photosensitive member which exhibits excellent potential and image formation properties stably under various environments, including a low-temperature and low-humidity environment and a high-temperature and high-humidity environment. When such a photosensitive member is repeatedly used under, for example, a low-temperature and low-humidity environment where the electrical resistance of the intermediate layer increases, then electric charge accumulates in the intermediate layer, thus increasing the residual potential and the potential of a bright portion. Under a high-temperature and high-humidity environment where the electrical resistance of the intermediate layer is reduced, the electrical barrier property of the intermediate layer is reduced. This accelerates carrier injection from the supporting member and thus reduces the potential of the dark portion when the photosensitive member is used repeatedly. Consequently, the density of a formed image is reduced under a high-temperature and high-humidity environment, and unnecessary black spots or fog readily occurs in the developed image when employing a reversal development type of electrophotographic printer.

The present inventors consider that the characteristics of the photosensitive member change during variations in the environment when utilizing a degraded dispersion of the conductive filler. In other words, a degraded dispersion of the conductive filler in the intermediate layer creates local changes in the electrical resistance thereof, which, in turn, make the potential or image characteristics of the photosensitive member very sensitive to changes in the environment.

SUMMARY OF THE INVENTION

An object of the present invention is to provide an electrophotographic photosensitive member which exhibits stable potential and image characteristics under various environments, including a low-temperature, low-humidity environment and a high-temperature and high-humidity environment, and an electrophotographic apparatus which employs such an electrophotographic photosensitive member.

To achieve the above object, the present invention provides an electrophotographic photosensitive member which comprises, in sequence, a supporting member, an intermediate layer and a photoconductive layer. The intermediate layer is located closer to the supporting member. The intermediate layer contains fine particles of tin oxide containing phosphorus. The fine particles may be added as a powder.

The present invention further provides an electrophotographic apparatus which comprises the above-described electrophotographic photosensitive member, charging means for charging the electrophotographic photosensitive member, image exposure means for performing an image exposure to the electrophotographic photosensitive member to form an electrostatic latent image, and development means for developing the electrostatic latent image formed on the electrophotographic photosensitive member with a toner.

DETAILED DESCRIPTION OF THE PREFERRED EMBODIMENTS

Figure 1:
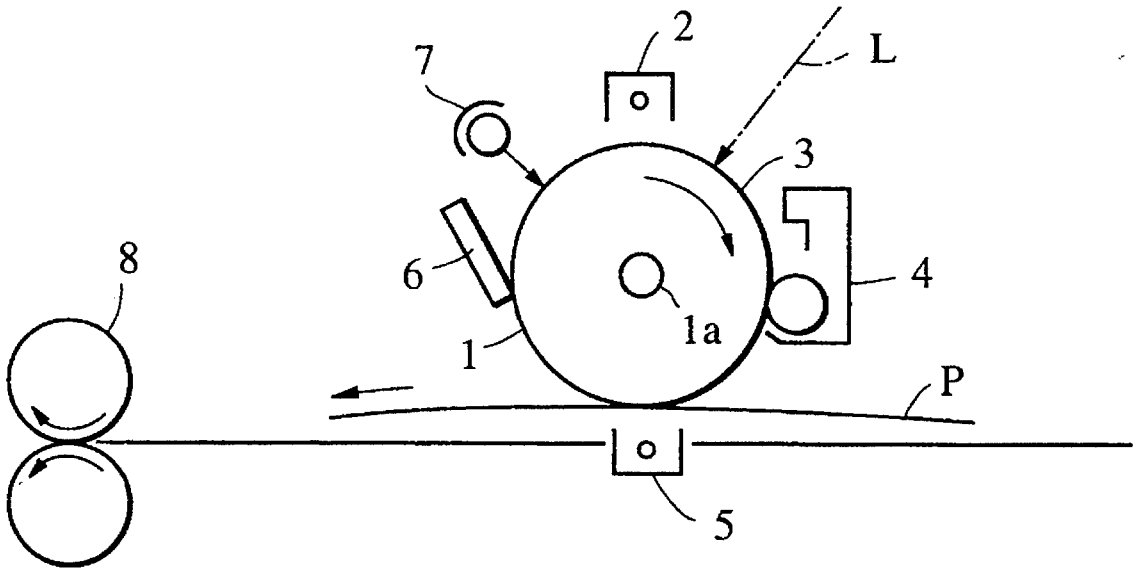
FIG. 1 is a side elevational view of an electrophotographic apparatus which employs an electrophotographic photosensitive member according to the present invention.

An electrophotographic photosensitive member according to the present invention includes a supporting member, and an intermediate layer and a photoconductive layer which are formed on the supporting member with the intermediate layer located closer to the supporting member. The intermediate layer contains, as a filler, a powder of fine particles of tin oxide containing phosphorus.

The fine particles of tin oxide containing phosphorus, employed in the present invention are a solid solution in which phosphorus atoms are introduced into a crystal lattice of tin oxide. The electrical resistance of the fine particles of tin oxide containing phosphorus is lower than that of fine particles of tin oxide which contain no phosphorus.

A desired specific resistivity of the powder employed in the present invention is between 10 and 100 Ωcm. Herein, a resistivity of the powder can be measured by a resistance measuring apparatus (Loresta AP, manufactured by Mitsubishi Yuka K.K.). More specifically, a coin-like sample is prepared by compressing the powder under a pressure of 500 $kg/cm^2$ and the sample is mounted or disposed on a prescribed position of the apparatus. A preferable proportion of phosphorus in the fine particles of tin oxide is between 0.01 and 30 wt %, with a more preferable amount ranging from 0.10 to 10 wt % based on the total weight of the fine particles. A preferable average particle size of the fine particles of tin oxide containing phosphorus is between 0.02 and 0.2 μm, with a more preferred size being between 0.02 and 0.1 μm. In the present invention, the average grain size of the fine particles is measured by a centrifugal sedimentation method.

As the average grain size of the filler becomes smaller, the dispersion thereof generally becomes more difficult. Therefore, the agglomeration tendency of the filler is generally enhanced. However, the filler employed in the present invention exhibits excellent dispersibility. A preferable amount of the filler in the intermediate layer is between 10 and 90 wt % with a more preferred amount between 5.0 and 80 wt %.

Suitable examples of the binder resin employed in the intermediate layer include a phenolic resin, a polyurethane, a polyamide, a polyimide, a polyamide-imide, a polyamide acid, a polyvinyl acetal, an epoxy resin, an acrylic resin, a melamine resin, a polyester and any combination of these resins. Such resins adhere well to the supporting member, improve dispersibility of the filler used in the present invention, and assure excellent solvent resistance of the formed film. Among the above-mentioned resins, a phenolic resin, a polyurethane and a polyamide acid are particularly preferable.

In order to improve the dispersibility of the filler, the surface of the filler may be treated using a treating agent, such as a coupling agent (including a silane coupling agent and a titanium coupling agent) or a silicone oil. The treating agent may be contained in the binder of the intermediate layer.

A preferable thickness of the intermediate layer is between 0.1 and 30 μm, with a more preferable thickness ranging between 0.5 and 10 μm. The volume resistivity of the intermediate layer is preferably $10^{13}$ Ωcm or less, more preferably, $10^{12}$ Ωcm or less and 10 Ωcm or more. Preferred results are obtained when the volume resistivity is from about 10Ω cm to $10^{13}$ Ωcm. A volume resistivity of an intermediate layer can be measured as follows.

A sample of an intermediate layer is applied onto an aluminum plate. On the coated aluminum plate, a thin film of gold is formed. A value of a current carried between the aluminum plate (as an electrode) and the gold thin film (as an electrode) is measured by using a pA meter to obtain a volume resistivity.

In addition to a powder which comprises the fine particles of tin oxide containing phosphorus, the intermediate layer may also contain a filler which comprises a powder of zinc oxide or titanium oxide. Further, a leveling agent may also be added to the intermediate layer in order to improve the leveling thereof.

The photoconductive layer according to the present invention may either be a single layer or a laminate structure of at least a charge generating layer and a charge transporting layer.

If the photoconductive layer is a single layer, a charge generating substance and a charge transporting substance are present in that layer so that light carriers can be generated and transported in the same layer.

If the photoconductive layer is a laminate, the charge generating layer, which contains a charge generating substance, and the charge transporting layer, which contains a charge transporting substance, may be formed with the charge generating layer located closer to the supporting member or vice versa.

Suitable examples of the charge generating substance include an azo type pigment, such as a monoazo pigment, a bisazo pigment or a trisazo pigment, a metal or non-metal phthalocyanine type pigment, an indigo type pigment, such as indigo or thioindigo, a quinone type pigment, such as anthoanthrone or pyrenequinone, a perylene type pigment, such as perylene acid anhydride or perylene acid imide, a squarium type coloring agent, a pyrylium salt, a thiapyrylium salt, and a triphenylmethane type coloring agent. Inorganic materials, such as selenium, selenium-tellurium or amorphous silicon, can also be used as the charge generating substance.

The charge transporting substance may be an electron transporting substance or a positive hole transporting substance. Examples of the electron transporting substance include 2,4,7-trinitrofluorenone, 2,4,5,7-tetranitrofluorenone, chloranyl and tetracyanoquinodimethane. Examples of the positive hole transporting substance include a polynuclear aromatic compound such as pyrene or anthracene; a heterocyclic compound such as carbazole, indole, imidazole, oxazole, thiazole, oxadiazole, pyrazole, pyrazoline, thiodiazole or triazole; a hydrazone type compound such as p-diethylaminobenzaldehyde-N,N-diphenylhydrazone or N,N-diphenylhydrazino- 3-methylidyne-9-ethyl carbazole; a styryl type compound such as α-phenyl-4' -N,N-diaminostilbene or 5-[4-(di-p-tolylamino) benzylidene]-5H-dibenzo [a,d]dicycloheptene; a benzidine type compound; and a triarylamine type compound.

When the photoconductive layer is a single layer, a preferable thickness thereof is between 5 and 100 μ, with more a preferable thickness being from 10 to 60 μm. A preferred amount of charge generating substance and a preferred amount of charge transporting substance in the single layer photoconductive layer are between 10 and 70 wt %, with a more preferable amount being between 20 and 70 wt % for each substance.

For the photoconductive layer having a laminate structure, a desirable thickness of the charge generating layer is between 0.001 μm and 5 μm, and a more desirable thickness is between 0.05 μm and 2 μm. A desirable thickness of the charge transporting layer of the laminate is between 1 μm and 40 μm, with a more desirable thickness being between 10 μm and 30 μm. A desirable amount of charge generating substance in the charge generating layer is between 10 wt % and 100 wt %, with a more desirable amount being between 40 wt % and 100 wt %. A desirable amount of charge transporting substance in the charge transporting layer is between 20 wt % and 80 wt %, with a more preferable amount being between 30 wt % and 70 wt %.

In the electrophotographic photosensitive member according to the present invention, the photoconductive layer may be formed by depositing the materials thereof on the supporting member by vacuum deposition or by combining the materials with a suitable binder resin.

Suitable examples of the binder resin for the photoconductive layer include a polyvinyl acetal, polycarbonate, a polystyrene, a polyester, a polyester acetate, a polymethacrylate, an acrylic resin and a cellulosic resin.

Some types of photoconductive layer materials allow free carriers to move from the intermediate layer into the photoconductive layer, thus reducing the chargeability of the photosensitive member. Consequently, the image forming characteristics are greatly affected. In such a case, a barrier layer (which may be a suitable thin film of resin) serving as an electric barrier may be provided between the intermediate layer and the photoconductive layer to effectively restrict the injection of free carriers. The barrier layer may be constituted of a water-soluble resin, such as a polyvinyl alcohol, a polyvinyl methyl ether, a polyacrylic acid, a methyl cellulose, an ethyl cellulose, a polyglutamic acid, casein or starch, or a resin, such as a polyamide, a polyimide, a polyamide-imide, a polyamide acid, a melamine resin, an epoxy resin, a polyurethane or a polyglutamate. Among these resins, a polyamide is particularly desirable from the viewpoint of the coating and adhesion properties, the solvent resistance, the electric barrier property and the resistance. A low-crystalline or non-crystalline copolymer nylon that can be coated from a solution is suitable as the polyamide. A desirable thickness of the barrier layer is between 0.1 μm and 2 μm.

In the electrophotographic photosensitive member according to the present invention, a protective layer may be provided on the photoconductive layer. The protective layer is mainly formed of a resin. Suitable examples of the material which forms the protective layer include a polyester, a polyurethane, a polyacrylate, a polyethylene, a polystyrene, a polybutadiene, a polycarbonate, a polyamide, a polypropylene, a polyimide, a polyamide-imide, a polysulfone, a polyarylether, a polyacetal, a nylon, a phenolic resin, an acrylic resin, a silicone resin, an epoxy resin, a urea resin, an allyl resin, an alkyd resin, and a butyral resin. A desirable thickness of the protective layer is between 0.05 μm and 15 μm, with a more desirable thickness ranging between 1 μm and 10 μm.

The supporting member may be made of a metal, such as aluminum, copper, titanium or a stainless steel, an alloy, such as an aluminium alloy, a polymer material, such as a polyethylene terephthalate, a polybutylene terephthalate, a phenolic resin, a polypropylene or a polystyrene, or a hard paper. The supporting member preferably has a cylindrical, a belt-like or a sheet-like shape. When the supporting member is made of a material having a high volume resistivity, it must be subjected to a conduction treatment. The supporting member may be made conductive by forming a conductive thin film on the supporting member or by dispersing a conductive substance in the supporting member.

The electrophotographic photosensitive member according to the present invention may be employed not only in electrophotographic copying machines, but also in devices used in various electrophotographic technologies, such as a laser beam printer, a CRT printer, an LED printer, a liquid crystal printer, a facsimile machine, or a laser reproduction.

The electrophotographic photosensitive member according to the present invention provides stable potential characteristics and excellent image formation under any environment including a low-temperature and low-humidity environment and a high-temperature and high-humidity environment.

An electrophotographic apparatus employing the electrophotographic photosensitive member according to the present invention will now be described. FIG. 1 is a schematic view of a transfer type electrophotographic apparatus which employs a drum type photosensitive member according to the present invention. In the figure, reference numeral 1 denotes a drum type photosensitive member according to the present invention which is rotatable about a shaft la in a direction indicated by the arrow at a predetermined peripheral speed. During the rotation, the peripheral surface of the photosensitive member 1 is positively or negatively charged uniformly to a predetermined potential by charging means 2, and then exposed to a light image L (a slit or laser beam scanning exposure) of an image exposure means (not shown) in an exposure portion 3, whereby an electrostatic latent image corresponding to the exposed image is sequentially formed on the peripheral surface of the photosensitive member. The electrostatic latent image is toner developed by developing means 4.

The toner developed image is sequentially transferred onto the surface of a recording material P which is fed between the photosensitive member 1 and a transfer means 5 from a sheet feeding portion (not shown) synchronously with the rotation of the photosensitive member 1 by the transfer means 5. The recording material P on which the image has been transferred is separated from the surface of the photosensitive member 1, introduced into image fixing means 8 for fixing the transferred image, and then discharged from the apparatus as a printed copy. Cleaning means 6 cleans the surface of the photosensitive member 1 by removing the toner remaining thereon after transfer, and exposure means 7 eliminates the charge remaining on the surface of the photosensitive member 1, whereby the photosensitive member 1 can be used repeatedly for image formation.

A corona charger is generally employed as the uniformly charging means 2 for the photosensitive member 1. Corona transfer means is generally used as the transfer device 5. Among the above-described components of the electrophotographic apparatus, such as the photosensitive member, the development means and cleaning means, a plurality of components may be combined as one unit which is detachably mounted on the apparatus body. For example, the photosensitive member 1 and the cleaning means 6 may be combined as one unit which can be detached from and mounted on the apparatus body using guiding means, such as a rail. In that case, the charging means and/or the developing means may also be incorporated in the unit. Further, when the electrophotographic apparatus is used as a copying machine or a printer, the light image L may be obtained from a light reflected by or transmitted through an original or by converting an original document into an electrical signal, by scanning a laser beam according to the obtained signal and by driving a light-emitting diode array or a liquid-crystal shutter array.

EXAMPLE 1

A solution composed of 140 parts by weight of filler comprising fine particles of tin oxide containing phosphorus (having a specific resistivity of 25 Ωcm), 70 parts by weight of a resol type phenolic resin (Plyophen J325 (trademark), manufactured by Dai-Nippon Ink & Chemicals, Inc., solid content: 70%) and 100 parts by weight of 2-methoxy-1-propanol was dispersed by a ball mill for about 30 hours. A measurement conducted using a granulometer (CAPA-700 (trademark) manufactured by Horiba Seisakusho) using the centrifugal sedimentation method indicated that the average grain size of the filler contained in the dispersion obtained was 0.08 μm. The amount of phosphorus in the fine particles was 1 wt %.

An intermediate layer was formed by coating the thus-prepared dispersion on an aluminum cylinder (whose surface roughness Rmax was 5 μm) having an outer diameter of 30 mm and a length of 360 mm by dipping and then heating the coated dispersion for 30 minutes at 140° C. to harden the layer formed. The surface roughness Rmax measured at that time was 0.4 μm. The roughness Rmax conforms to JIS B0601.

Next, a solution was prepared by dissolving 10 parts by weight of a copolymer nylon (Amilan CM8000 (trademark), manufactured by Toray Industries, Inc. ) in a mixture of 60 parts by weight of methanol and 40 parts by weight of butanol. A barrier layer was formed having a thickness of 0.5 μm on the intermediate layer by coating the obtained composition on the intermediate layer by dipping and then by heating the coated solution for 10 minutes at 90° C. to dry the layer.

Next, a dispersion for the charge generating layer was prepared by dispersing a solution composed of 4 parts by weight of titanyl oxyphthalocyanine, 2 parts by weight of polyvinyl butyral (BX-1 (trademark), manufactured by Sekisui Chemical Co., Ltd.) and 34 parts by weight of cyclohexane, for 8 hours with a sand mill and then adding 60 parts by weight of tetrahydrofuran to the dispersion. The charge generating layer was formed on the barrier layer by coating the thus-obtained dispersion on the barrier layer by dipping and then by heating the coated dispersion at 80° C. for 10 minutes to dry the layer formed. The thickness of the charge generating layer formed was about 0.2 μm.

A solution was prepared by dissolving 50 parts by weight of triallyl amine compound expressed by the following structural formula and 50 parts by weight of polycarbonate (Iupilon Z-200 (trademark), manufactured by Mitsubishi Gas Chemical Industries Ltd.) in 400 parts by weight of monochlorobenzene.

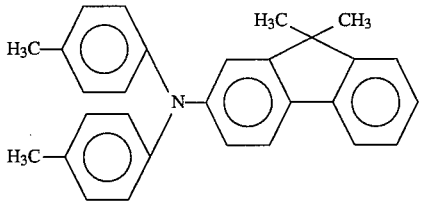

A charge transporting layer was formed having a thickness of 20 μm on the charge generating layer by coating the obtained solution on the charge generating layer by dipping and then by heating the coated solution at 120° C. for 1 hour to dry it.

The thus-obtained electrophotographic photosensitive member according to the present invention was mounted on a normal development type electrophotographic copying machine, and a process, consisting of charging, exposure, transfer and cleaning, was repeated at a cycle of 0.8 second. The evaluation of the electrophotographic characteristics of the photosensitive member conducted under a low-temperature and low-humidity environment (15° C. and 15 %RH) indicated that a difference between a dark potential ($V_D$) and a bright potential ($V_L$) was large enough to ensure a sufficient contrast as shown in Table 1. Successive copying conducted on 10,000 sheets of recording paper did not substantially change either the dark potential or the bright potential; that is, images having a very stable quality could be obtained.

TABLE 1

| | Initial Stage (V) | After copying 10,000 sheets (V) |
|---|---|---|
| Dark Potential ($V_D$) | −705 | −705 |
| Bright Potential ($V_L$) | −195 | −200 |

EXAMPLE 2

An electrophotographic photosensitive member according to the present invention was manufactured in the same manner as that of Example 1 except that an aluminum cylinder having an outer diameter of 30 mm and a length of 260 mm was used in place of the aluminum cylinder having the above-described dimensions. The thus-obtained electrophotographic photosensitive member according to the present invention was mounted on a reversal development type electrophotographic copying machine, and the process, consisting of charging, exposure, transfer and cleaning, was repeated at a cycle of 6 seconds. The evaluation of the electrophotographic characteristics of the photosensitive member conducted under a high-temperature and high-humidity environment (30° C. and 85 %RH) indicated that a difference between a dark potential ($V_D$) and a bright potential ($V_L$) was large enough to ensure a sufficient contrast, as shown in Table 2. Successive copying conducted on 5,000 sheets of recording paper did not substantially change either the dark potential or the bright potential; that is, images having a very stable quality could be obtained without black defects or fog.

TABLE 2

| | Initial Stage (V) | After copying 10,000 sheets (V) |
|---|---|---|
| Dark Potential ($V_D$) | −700 | −700 |
| Bright Potential ($V_L$) | −200 | −200 |

EXAMPLE 3

An electrophotographic photosensitive member according to the present invention was manufactured in the same manner as that of Example 1 except the filler was replaced by powder comprising fine particles of tin oxide containing 5 wt % of phosphorus (having a specific resistance of 12 Ωcm) and that the binder resin in the intermediate layer was replaced by a polyurethane (Nipporan 2304 (trademark), manufactured by Nippon Polyurethane Industry Co., Ltd.). The measurement, conducted in the same manner as that of Example 1, indicated that the average grain size of the filler contained in the dispersion for the intermediate layer was 0.10 μm.

The thus-obtained electrophotographic photosensitive member according to the present invention was mounted on a normal development-type electrophotographic copying machine, and the process, consisting of charging, exposure, transfer and cleaning, was repeated at a cycle of 0.8 second. The evaluation of the electrophotographic characteristics of the photosensitive member conducted under a low-temperature and low-humidity environment (15° C. and 15 %RH) indicated that a difference between a dark potential ($V_D$) and a bright potential ($V_L$) was large enough to ensure a sufficient contrast, as shown in Table 3. Successive copying conducted on 10,000 sheets of recording paper did not substantially change either the dark potential or the bright potential; that is, copies having a very stable image quality could be obtained.

TABLE 3

| | Initial Stage (V) | After copying 10,000 sheets (V) |
|---|---|---|
| Dark Potential ($V_D$) | −705 | −700 |
| Bright Potential ($V_L$) | −205 | −210 |

EXAMPLE 4

An electrophotographic photosensitive member according to the present invention was manufactured in the same manner as that of Example 1 except that the filler was replaced by powder comprising fine particles of tin oxide containing 10 wt % of phosphorus (having a specific resistance of 10 Ωcm) and the binder resin in the intermediate layer was replaced by a polyamide acid having the following structural formula.

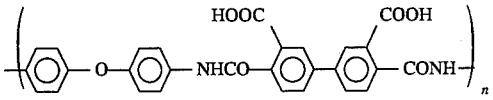

The measurement conducted in the same manner as that of Example 1 indicated that the average grain size of the filler contained in the dispersion for the intermediate layer was 0.09 μm.

The thus-obtained electrophotographic photosensitive member according to the present invention was mounted on a normal development type electrophotographic copying machine, and the process, consisting of charging, exposure, transfer and cleaning, was repeated at a cycle of 0.8 second. The evaluation of the electrophotographic characteristics of the photosensitive member conducted under a low-temperature and low-humidity environment (15° C. and 15 %RH) indicated that a difference between a dark potential ($V_D$) and a bright potential ($V_L$) was large enough to ensure a sufficient contrast, as shown in Table 4. Successive copying conducted on 10,000 sheets of recording paper did not substantially change the potentials; that is, copies having a very stable image quality could be obtained.

TABLE 4

| | Initial Stage (V) | After copying 10,000 sheets (V) |
|---|---|---|
| Dark Potential ($V_D$) | −700 | −695 |
| Bright Potential ($V_L$) | −200 | −200 |

Comparative Examples 1 and 2

Electrophotographic photosensitive members of Comparative Examples 1 and 2 were manufactured in the same manner as that of Example 1 except that the intermediate layer was replaced by those formed using the following coating solutions. Each of the thus-obtained electrophotographic photosensitive members was mounted on a normal development type electrophotographic copying machine, and the process, consisting of charging, exposure, transfer and cleaning, was repeated at a cycle of 0.8 second.

The evaluation of the electrophotographic characteristics of each of the photosensitive members conducted under a low-temperature and low-humidity environment (15° C. and 15 %RH) indicated that a difference between a dark potential ($V_D$) and a bright potential ($V_L$) was great enough to assure a sufficient contrast, as shown in Table 5. However, successive copying conducted on 10,000 sheets of recording paper decreased the dark potential and increased the bright potential in each of the electrophotographic photosensitive members.

Formulation for Comparative Example 1

Coated powder comprising titanium oxide fine particles having a coating layer of tin oxide containing antimony . . . 100 parts by weight
(ECTT-1, (trademark), manufactured by Titan Kogyo Kabushiki Kaisha)

Resol type phenolic resin . . . 70 parts by weight
(Plyophen J-325 (trademark))

Methyl cellosolve . . . 80 parts by weight

Formulation of Comparative Example 2

Powder comprising tin oxide fine particles containing antimony . . . 120 parts by weight
(T-1, (trademark), manufactured by Mitsubishi Materials Corporation)

Polyester-polyurethane . . . 70 parts by weight
(Nipporan 2304, (trademark))

-2-methoxy-1-propanol . . . 80 parts by weight

TABLE 5

| | Initial Stage (V) | | After copying 10000 sheets (V) | |
|---|---|---|---|---|
| | Dark Potential $V_D$ | Bright Potential $V_L$ | Dark Potential $V_D$ | Bright Potential $V_L$ |
| Comparative Example 1 | −710 | −210 | −680 | −300 |
| Comparative Example 2 | −695 | −195 | −605 | −290 |

EXAMPLES 5 AND 6

Electrophotographic photosensitive members of Examples 5 and 6 were manufactured in the same manner as those of Examples 3 and 4 except that the aluminum cylinder was replaced by an aluminum cylinder having an outer diameter of 30 mm and a length of 260 mm. Each of the thus-obtained electrophotographic photosensitive members according to the present invention was mounted on a reversal development type electrophotographic printer, and the process, consisting of charging, exposure, transfer and cleaning, was repeated at a cycle of 6 seconds. The evaluation of the electrophotographic characteristics of each of the photosensitive members conducted under a high-temperature and high-humidity environment (30° C. and 85 %RH) indicated that a difference between a dark potential ($V_D$) and a bright potential ($V_L$) was large enough to ensure a sufficient contrast, as shown in Table 6. Successive printing conducted on 5,000 sheets of recording paper failed to substantially change either the dark potential or the bright potential in each of the electrophotographic photosensitive members and images having a very stable quality could be obtained without generating unnecessary black spots or fog.

TABLE 6

| | Initial Stage (V) | | After copying 10000 sheets (V) | |
|---|---|---|---|---|
| | Dark Potential $V_D$ | Bright Potential $V_L$ | Dark Potential $V_D$ | Bright Potential $V_L$ |
| Example 5 | −695 | −200 | −690 | −200 |
| Example 6 | −705 | −195 | −700 | −195 |

Comparative Examples 3 and 4

Electrophotographic photosensitive members of Comparative Examples 3 and 4 were manufactured in the same manner as those of Comparative Examples 1 and 2 except that the aluminum cylinder was replaced by an aluminum cylinder having an outer diameter of 30 mm and a length of 260 mm. Each of the thus-obtained electrophotographic photosensitive members was mounted on a reversal development type electrophotographic printer, and the process, consisting of charging, exposure, transfer and cleaning, was repeated at a cycle of 6 seconds. The evaluation of the electrophotographic characteristics of each of the photosensitive members conducted under a high-temperature and high-humidity environment (30° C. and 85 %RH) indicated that a difference between a dark potential ($V_D$) and a bright potential ($V_L$) was large enough to ensure a sufficient contrast at the initial stage, as shown in Table 7. However, successive printing conducted on 5,000 sheets of recording paper reduced the dark potential, and unnecessary black spots were generated on the original images obtained from the beginning of the printing operation.

TABLE 7

| | Initial Stage (V) | | After copying 10000 sheets (V) | |
|---|---|---|---|---|
| | Dark Potential $V_D$ | Bright Potential $V_L$ | Dark Potential $V_D$ | Bright Potential $V_L$ |
| Comparative Example 3 | −690 | −200 | −635 | −180 |
| Comparative Example 4 | −705 | −195 | −590 | −170 |

EXAMPLE 7

An intermediate layer having a thickness of 5 μm was formed by coating a dispersion for the intermediate layer having the same composition as that of Example 1 on an aluminum plate having a length of 250 mm, a width of 150 mm and a thickness of 0.5 mm with a Meyer bar and then by drying the coated dispersion at 140° C. for 30 minutes.

Next, 90 parts by weight of tetrahydrofuran was added to and dispersed in 5 parts by weight of bisazo pigment having the following structural formula for 20 hours by a sand mill.

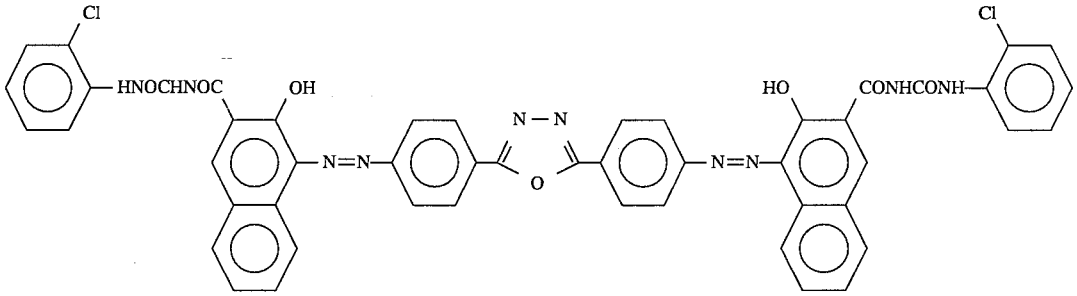

A solution obtained by dissolving 2.5 parts by weight of a butyral resin (BLS (trademark), manufactured by Sekisui Chemical Co., Ltd.) in 20 parts by weight of tetrahydrofuran was added to and dispersed in the above-described solution for 2 hours. 100 parts by weight of cyclohexanone and 100 parts by weight of tetrahydrofuran were added to the thus-obtained dispersion to dilute the dispersion, and the diluted dispersion was coated on the intermediate layer to a thickness of 0.2 μm with a Meyer bar to form a charge generating layer.

Subsequently, a solution was prepared by dissolving 50 parts by weight of a styryl component having the following structural formula and 50 parts by weight of polycarbonate (Iupilon Z-200 (trademark), manufactured by Mitsubishi Gas Chemical Industries Ltd.) in 400 parts by weight of monochlorobenzene.

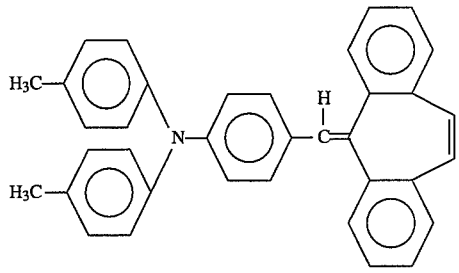

A charge transporting layer was formed on the charge generating layer to a thickness of 20 μm by coating the solution on the charge generating layer by dipping and then by heating the coating solution at 120° C. for 1 hour to dry it, whereby an electrophotographic photosensitive member according to the present invention was produced.

The charging characteristics of the thus-formed electrophotographic photosensitive member were evaluated using an electrostatic copying machine testing apparatus (Model SP-428 (trademark), manufactured by Kawaguchi Denki Kabushiki Kaisha). The evaluation was conducted by negatively charging the electrophotographic photosensitive member to −5 kV by corona discharging, exposing the member to an illumination of 10 lux obtained by a halogen lamp after it had been left in the dark for 1 second and then by measuring an initial surface potential ($V_0$), an exposure ($E_{1/2}$) required to attenuate the surface potential obtained after the member had been left in the dark to one half the original value and a residual potential ($V_r$). Table 8 shows the results of the evaluation.

EXAMPLES 8 AND 9

Electrophotographic photosensitive members of Examples 8 and 9 were manufactured in the same manner as that of Example 7 except that the intermediate layer was replaced by the same intermediate layer as that used in Examples 3 and 4 and that a barrier layer was provided on the intermediate layer. The charging characteristics of each of the electrophotographic photosensitive members were evaluated by the same method as that used in Example 7. The barrier layer had a thickness of 1 μm and was formed using the same dispersion for the barrier layer as that used in Example 1.

The results of the evaluation are shown in Table 8.

TABLE 8

| | $V_O$ (−V) | $V_r$ (−V) | $E_{1/2}$ (lux · sec) |
|---|---|---|---|
| Example 7 | 710 | 0 | 1.08 |
| Example 8 | 705 | 0 | 1.09 |
| Example 9 | 710 | 0 | 0.98 |

Comparative Examples 5 and 6

Electrophotographic photosensitive members of Comparative Examples 5 and 6 were manufactured in the same manner as that of Example 8 except that the intermediate layer was replaced by the same intermediate layer as that used in Comparative Examples 1 and 2. The charging characteristics of each of the electrophotographic photosensitive members were evaluated by the same method as that used in Example 7. The results of the evaluation are shown in Table 9. The electrophotographic sensitivity of the electrophotographic photosensitive members of Comparative Examples 5 and 6 is clearly lower than that of the electrophotographic photosensitive members of Examples 7 through 9.

TABLE 9

| | $V_O$ (V) | $V_r$ (V) | $E_{1/2}$ (lux · sec) |
|---|---|---|---|
| Comparative Example 7 | 705 | 0 | 1.20 |
| Comparative Example 8 | 700 | 0 | 1.23 |

This invention is not to be limited except as set forth in the claims which follow. Other variations and embodiments of this invention will be apparent to those skilled in this art and are included in this invention.

What is claimed is:

1. An electrophotographic photosensitive member comprising in sequence:

a supporting member;

an intermediate layer containing fine particles of tin oxide containing phosphorous; and a photoconductive layer.

2. The electrophotographic photosensitive member according to claim 1, wherein said fine particles are a powder having an average grain size ranging between 0.02 μm and 0.2 μm.

3. The electrophotographic photosensitive member according to claim 2, wherein said average grain size ranges between 0.02 μm and 0.1 μm.

4. The electrophotographic photosensitive member according to claim 1, wherein said phosphorus is present in said fine particles in amounts between 0.01 wt % and 30 wt %.

5. The electrophotographic photosensitive member according to claim 4, wherein said phosphorus is present in said fine particles in amounts between 0.10 wt % and 10 wt %.

6. The electrophotographic photosensitive member according to claim 1, wherein said intermediate layer contains a binder resin comprising a polymer selected from the group consisting of a phenolic resin, a polyurethane, a polyamide, a polyimide, a polyamide-imide, a polyamide acid, a polyvinyl acetal, an epoxy resin, an acrylic resin, a melamine resin and a polyester.

7. The electrophotographic photosensitive member according to claim 6, wherein said binder resin is a phenolic resin, a polyurethane or a polyamide acid.

8. The electrophotographic photosensitive member according to claim 1, further comprising a barrier layer provided between said intermediate layer and said photoconductive layer.

9. An electrophotographic apparatus comprising:

said electrophotographic photosensitive member of claim 1;

charging means for charging said electrophotographic photosensitive member;

image exposure means for image exposing the charged electrophotographic photosensitive member to form an electrostatic latent image; and development means for developing said electrostatic latent image formed on said electrophotographic photosensitive member with a toner.

10. An apparatus unit adapted to be detachably mounted on a main body of an electrophotographic apparatus comprising:

(a) the electrophotographic photosensitive member of claim 1; and (b) at least one component selected from the group consisting of a charging means, a development means and a cleaning means.

* * * * *

UNITED STATES PATENT AND TRADEMARK OFFICE

CERTIFICATE OF CORRECTION

PATENT NO. : 5,468,584

DATED : November 21, 1995

INVENTOR(S) : SHINTETSU GO ET AL.

It is certified that error appears in the above-identified patent and that said Letters Patent is hereby corrected as shown below:

Title page, item [54], should read --Phosphorus--.

On the title page, item [57], Abstract

AT [57] ABSTRACT

Line 2, "orders," should read --order,-- and "and" (first occurrence) should be deleted.

COLUMN 1

Line 5, "PHOSPHOROUS" should read --PHOSPHORUS--.

COLUMN 2

Line 64, "DRAWINGS" should read --DRAWING--.

COLUMN 3

Line 13, "phosphorous" should read --phosphorus--.
Line 26, "position" should read --portion--.
Line 42, "90 wt %" should read --90 wt %,--.

UNITED STATES PATENT AND TRADEMARK OFFICE

CERTIFICATE OF CORRECTION

PATENT NO. : 5,468,584

DATED : November 21, 1995

INVENTOR(S) : SHINTETSU GO ET AL.

It is certified that error appears in the above-identified patent and that said Letters Patent is hereby corrected as shown below:

COLUMN 5

Line 60, "aluminium" should read --aluminum--.

COLUMN 7

Line 9, "(Plyophen J325" should read --Plyophen J-325--.

COLUMN 8

Line 53, "10,000" should read --5,000--.

COLUMN 11

Line 21, "10000" should read --5000--.

COLUMN 12

Line 4, "10000" should read --5000--.

UNITED STATES PATENT AND TRADEMARK OFFICE

CERTIFICATE OF CORRECTION

PATENT NO. : 5,468,584

DATED : November 21, 1995

INVENTOR(S) : SHINTETSU GO ET AL.

It is certified that error appears in the above-identified patent and that said Letters Patent is hereby corrected as shown below:

COLUMN 14

Line 8, "Comparative Example 7" should read --Comparative Example 5--.
Line 9, "Comparative Example 8" should read --Comparative Example 6--.
Line 22, "phosphorous;" should read --phosphorus;--.

Signed and Sealed this

Fourteenth Day of May, 1996

*Attest:*

Bruce Lehman

BRUCE LEHMAN

*Attesting Officer*

*Commissioner of Patents and Trademarks*